US009335093B2

(12) United States Patent
Feldman et al.

(10) Patent No.: US 9,335,093 B2
(45) Date of Patent: May 10, 2016

(54) SYSTEMS AND METHODS FOR EFFICIENT MICROWAVE DRYING OF EXTRUDED HONEYCOMB STRUCTURES

(71) Applicant: CORNING INCORPORATED, Corning, NY (US)

(72) Inventors: James Anthony Feldman, Campbell, NY (US); Jacob George, Horseheads, NY (US); Amit Halder, Painted Post, NY (US); Nadezhda Pavlovna Paramonova, Saint Petersburg (RU)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 14/705,452

(22) Filed: May 6, 2015

(65) Prior Publication Data

US 2015/0233636 A1 Aug. 20, 2015

Related U.S. Application Data

(62) Division of application No. 13/306,359, filed on Nov. 29, 2011, now Pat. No. 9,038,284.

(51) Int. Cl.

| | |
|---|---|
| ***F26B 3/347*** | (2006.01) |
| ***F26B 15/14*** | (2006.01) |
| ***F26B 3/28*** | (2006.01) |
| ***B28B 11/24*** | (2006.01) |
| ***F26B 15/10*** | (2006.01) |
| ***F26B 23/04*** | (2006.01) |

(52) U.S. Cl.

CPC ..... *F26B 3/347* (2013.01); *B28B 11/241* (2013.01); *F26B 3/28* (2013.01); *F26B 15/10* (2013.01); *F26B 15/14* (2013.01); *F26B 23/04* (2013.01)

(58) Field of Classification Search

CPC ..... F26B 3/343; F26B 3/347; F26B 5/048; F26B 15/12; F26B 15/14; F26B 15/146

See application file for complete search history.

(56) References Cited

U.S. PATENT DOCUMENTS

| | | | | |
|---|---|---|---|---|
| 3,704,523 | A | 12/1972 | Guerga et al. | 34/264 |
| 4,771,153 | A | 9/1988 | Fukushima et al. | 219/10.55 B |
| 5,837,978 | A | 11/1998 | Hatzakis, Jr. et al. | 219/702 |
| 6,259,078 | B1 | 7/2001 | Araya | 219/709 |
| 6,768,089 | B2 | 7/2004 | Minobe et al. | 219/699 |
| 8,729,436 | B2 | 5/2014 | Adrian et al. | 219/681 |
| 2002/0093123 | A1 | 7/2002 | Miura et al. | 264/432 |

(Continued)

*Primary Examiner* — David J Laux

(74) *Attorney, Agent, or Firm* — Joseph M. Homa

(57) ABSTRACT

Systems and methods for efficient microwave drying of extruded honeycomb structures are disclosed. The methods include conveying first and second sets of honeycomb structures in opposite directions through multiple applicator cavities. Each honeycomb structure has a moisture content $M_C$, and the honeycomb structures within each cavity define an average moisture content $M_{CA}$ between 40% and 60% therein. The methods include irradiating the first and second sets of honeycomb structures within the cavities with microwave radiation having an amount of input microwave power $P_I$ that results in an amount of reflected microwave power $P_R$ from the honeycomb structures, where $P_R<(0.2)P_I$. This allows for a relatively high microwave power to be maintained in each cavity. Batch microwave drying methods are also disclosed.

5 Claims, 12 Drawing Sheets

(56) References Cited

U.S. PATENT DOCUMENTS

| | | | | |
|---|---|---|---|---|
| 2004/0104514 | A1 | 6/2004 | Ishikawa et al. | 264/489 |
| 2005/0093209 | A1 | 5/2005 | Bergman et al. | 264/474 |
| 2006/0042116 | A1 | 3/2006 | Terazawa et al. | 34/259 |
| 2009/0294438 | A1 | 12/2009 | Adrian et al. | 219/681 |
| 2009/0294440 | A1 | 12/2009 | Adrian et al. | 219/750 |
| 2010/0107435 | A1 | 5/2010 | George et al. | 34/259 |
| 2010/0126035 | A1 | 5/2010 | Kobayashi et al. | 34/259 |
| 2011/0120991 | A1 | 5/2011 | Armenta Pitsakis | 219/702 |
| 2011/0204548 | A1 | 8/2011 | George et al. | 264/638 |
| 2012/0049415 | A1 | 3/2012 | George et al. | 264/432 |

SYSTEMS AND METHODS FOR EFFICIENT MICROWAVE DRYING OF EXTRUDED HONEYCOMB STRUCTURES

CROSS-REFERENCE TO RELATED APPLICATIONS

This application is a divisional of and claims the benefit of priority to U.S. patent application Ser. No. 13/306,359, filed on Nov. 29, 2011, the content of which is relied upon and incorporated herein by reference in its entirety.

FIELD

The present invention relates to the microwave drying of extruded honeycomb structures, and in particular relates to systems and methods for efficient microwave drying of extruded honeycomb structures.

BACKGROUND

Microwave radiation is used for drying honeycomb structures that are formed by extrusion and used for a variety of applications such as engine filters, catalytic converters, and the like. In comparison with conventional heat-based oven drying, microwave drying provides a higher drying rate and is generally faster because the honeycomb structure or "log" is heated directly through the interaction of the microwave energy with the water in the log.

Microwave drying is carried out in a microwave dryer that includes at least one applicator, and that often has a series of applicators, e.g., two or three. A portion of the microwave radiation introduced into a given applicator is absorbed (dissipated) in the log during the drying process. The amount of microwave power dissipation is generally proportional to the water (moisture) content in the log. For example, a wet log (e.g., a newly extruded log) will generally absorb more power than a dry log. During the drying process, the microwave radiation that is not absorbed by the honeycomb structure is either absorbed by other materials in the applicator or reflected back to the generator and therefore does not contribute to the drying process. A large amount of reflected microwave radiation can cause throughput reduction, inefficiency in the manufacturing process, and damage to the microwave radiation source (e.g., magnetron).

To have an efficient microwave process, it is desirable to keep the amount of reflected microwave power within a given applicator to within an acceptable limit or threshold, e.g., less than about 20% of the output power. Toward the end of the drying process when the logs are nearly dry and nearly ready to exit the applicator, the applicator system can reflect a large amount of microwave power. Consequently, to maintain the amount of reflected microwave power within an acceptable limit, the amount of microwave radiation (power) needs to be reduced. While effective, this approach leads to the underutilization of the applicator.

SUMMARY

Aspects of the disclosure are directed to systems and methods of efficiently performing microwave drying of honeycomb structures in an applicator. The systems and methods include providing a cross-flow of wet and partially dry honeycomb structures to ensure that both wet and partially dry honeycomb structures are present in the applicator at all times. This arrangement ensures that wet honeycomb structures are present in all applicators, which keeps the reflected power in each the applicator low. This allows the applicator(s) to operate closer to their maximum capacity. The systems include various conveying configurations for providing a good mix of wet and partially dry honeycomb structures to one or many applicators in a typical microwave dryer.

An aspect of the disclosure is a method of efficiently drying honeycomb structures in a microwave dryer having at least one applicator. The method includes conveying first and second sets of at least one honeycomb structure per set in opposite directions through at least one applicator having a cavity, wherein each honeycomb structure has a moisture content $M_C$, and wherein an average moisture content $M_{CA}$ averaged over all of the honeycomb structures within the cavity during drying is between 40% and 60%. The method also includes irradiating the first and second sets of honeycomb structures within the cavity with microwave radiation to effectuate drying. The microwave radiation has an amount of input microwave power $P_I$ that creates an amount of reflected microwave power $P_R$ from the honeycomb structures, where $P_R<(0.2)P_I$.

Another aspect of the disclosure is a method of microwave drying extruded honeycomb structures or "logs" in a batch configuration in a microwave applicator having a cavity. The method includes arranging a plurality of first wet logs in the cavity, and microwave drying the first wet logs for a first drying time at a first input microwave power to form therefrom one or more partially dry logs. The method also includes, after the first drying time, swapping at least one of the partially dry logs for at least one second wet log. The method then includes microwave drying the logs that reside in the cavity at a second input microwave power that is the same or greater than the first microwave input power, and for a second drying time.

Another aspect of the disclosure is a system for microwave drying extruded logs. The system includes one or more applicators each having a cavity. The system also has first and second conveyors configured to convey the first and second sets of logs in opposite directions through each cavity. Each log has the moisture content $M_C$. The logs define the average moisture content $M_{CA}$ averaged over all of the logs within the cavity during drying, wherein $40\%\leq M_{CA}\leq 60\%$. The system also has at least one generation source of microwave radiation operably arranged relative to the at least one applicator and its cavity. The microwave generation source is configured to irradiate the first and second sets of logs within the cavity with microwave radiation to effectuate drying. The microwave radiation has an amount of the input microwave power $P_I$ that creates an amount of the reflected microwave power $P_R$ from the honeycomb structures, where $P_R<(0.2)P_I$.

Another aspect of the disclosure is a method of efficiently drying logs in a microwave dryer having at least a first-end applicator and a second-end applicator having respective first and second cavities. The method includes conveying first wet logs from the first to the second cavity while microwave drying the first wet logs in the first cavity to form first partially dry logs that enter the second cavity, and microwave drying the first partially dry logs in the second cavity to form first dry logs that exit the second cavity. The method also includes conveying second wet logs from the second cavity to the first cavity during microwave drying of the first partially dry logs in the second cavity, thereby forming second partially dry logs that enter the first cavity, and then microwave drying the second partially dry logs in the first cavity during microwave drying of the first wet logs in the first cavity to form second dry logs that exit the first cavity.

Another aspect of the disclosure is a method of microwave drying extruded logs. The method includes arranging first and second sets of wet logs respectively at a first end of a first applicator having a first cavity and at a second end of a second applicator having a second cavity. The method also includes counter-propagating the first and second sets of logs through the first and second applicator cavities while maintaining substantially equal amounts of input microwave power in each cavity. The method also includes outputting the first set of wet logs from the second cavity as a first set of either nearly dry logs or dry logs, and outputting the second set of wet logs from the first cavity as a second set of either nearly dry logs or dry logs.

It is to be understood that both the foregoing general description and the following Detailed Description represent embodiments of the disclosure, and are intended to provide an overview or framework for understanding the nature and character of the disclosure as it is claimed. The accompanying drawings are included to provide a further understanding of the disclosure, and are incorporated into and constitute a part of this specification. The drawings illustrate various embodiments of the disclosure and together with the description serve to explain the principles and operations of the disclosure.

Additional features and advantages of the disclosure are set forth in the detailed description that follows, and in part will be readily apparent to those skilled in the art from that description or recognized by practicing the disclosure as described herein, including the detailed description that follows, the claims, and the appended drawings. The claims are incorporated into and constitute part of the Detailed Description set forth below.

Additional features and advantages of the disclosure are set forth in the Detailed Description that follows and will be apparent to those skilled in the art from the description or recognized by practicing the disclosure as described herein, together with the claims and appended drawings.

Cartesian coordinates are shown in certain of the Figures for the sake of reference and are not intended as limiting with respect to direction or orientation.

DETAILED DESCRIPTION

Figure 1:
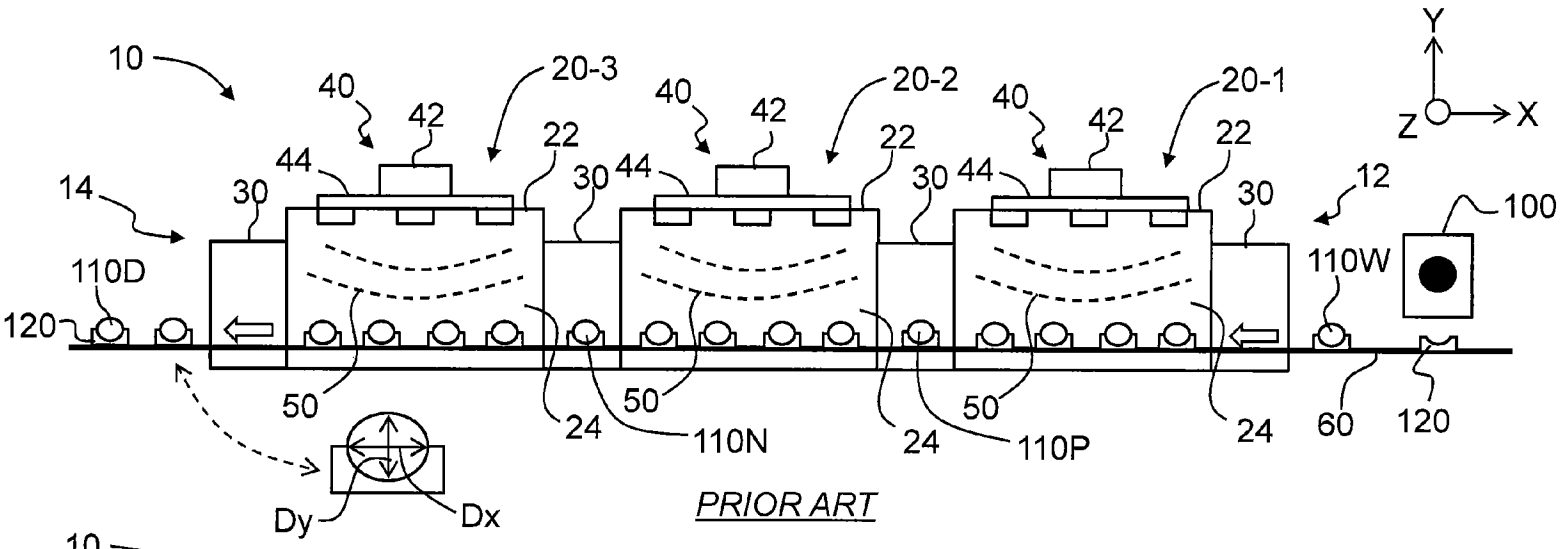
PRIOR ART FIG. 1
FIG. 1 is a cross-sectional view of an example prior art microwave dryer that has three applicators.
Figure 2:
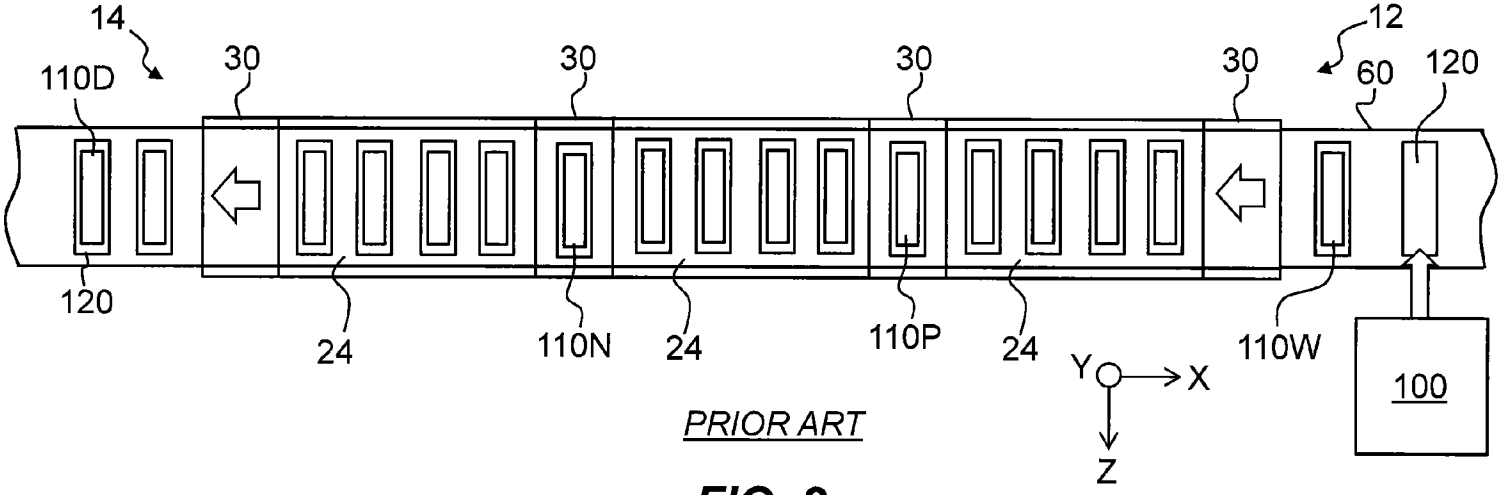
PRIOR ART FIG. 2
FIG. 2 is a top-down cut-away view of the prior art microwave dryer of FIG. 1 but without the microwave generating system for ease of illustration.

FIG. 1 is a cross-sectional view of an example prior art microwave dryer 10. FIG. 2 is a top-down, cut-away view of the prior art microwave dryer of FIG. 1, but without the microwave generating system shown for ease of illustration.

The microwave dryer 10 has first and second ends 12 and 14 that serve as input and output ends, respectively. The microwave dryer 10 includes by way of example three applicators 20, namely, 20-1, 20-2 and 20-3. Generally, one or more applicators 20 are used. The applicator 20 at first end 12 can be referred to as the first-end applicator, and applicator 20 at second end 14 can be referred to as the second-end applicator. In an example, microwave dryer 10 includes at least first-end and second-end applicators 20 (i.e., at least two applicators). The microwave dryer 10 also includes transition housings 30 that connect adjacent applicators 20 and reside at first and second dryer ends 12 and 14 and serve as covers.

The applicators 20 each have a top 22 and an interior cavity ("cavity") 24, which is sized to accommodate multiple honeycomb structures or logs 110 (introduced and discussed below) and in which the drying of the honeycomb structures or logs takes place. The applicator 20 supports (e.g., at top surface 22) a microwave generating system 40 that includes a microwave source 42 and microwave waveguides 44. The microwave waveguides 44 are operably arranged to introduce microwave radiation ("microwaves") 50 into applicator cavity 24. In an example, microwaves 50 have a wavelength comparable to the diameter of honeycomb structures or "logs" 110. The microwave waveguides 44 are shown for ease of illustration as residing near top 22 of applicator 20 in cavity 24. However, microwave waveguides 44 are configured relative to cavity 24 to provide a generally uniform distribution of microwave radiation 50 in the region of the cavity through which logs 110 travel while being dried, as discussed below. The microwave dryer 10 includes a conveyor 60 that extends through each applicator 20 from input end 12 to output end 14.

Also shown in FIG. 2 is an extruder system 100 disposed adjacent input end 12 of microwave dryer 10 and configured to extrude logs 110. Logs 110 are formed by extruder system 100 extruding a batch of ceramic-based material (not shown) into a substantially cylindrical shape and then cutting the extruded material to form a log of a select length. The logs 110 have a moisture content $M_C$ given in weight-%, and all moisture content values herein are assumed to be in weight-% unless stated otherwise. In an example as used hereinbelow, the moisture content $M_C$ is defined as the transient moisture mass in the log divided by the initial moisture mass in the log at the time of extrusion. Note that the moisture content $M_C$ is a variable and can be different for different logs 110.

In an example, logs 110 have an internal honeycomb structure. The ceramic-based material used to form logs 110 can be any ceramic-based material known in the art and used to form ceramic articles, such as the aforementioned engine filters, wherein the ceramic-based material has a moisture content $M_C$ that can be substantially changed (e.g., by more than 10%) by microwave drying. In an example, the ceramic-based material has a moisture content $M_C$ such that logs 110 can be microwave dried to have a moisture content $M_C \leq 2\%$. Example ceramic-based materials that meet the $M_C \leq 2\%$ requirement include aluminum-titanate (AT)-based ceramic-based materials and cordierite.

Each log 110 is supported on conveyor 60 by a tray 120. The logs 110 typically have a substantial moisture content upon being extruded, so that such newly extruded logs are referred to herein as "wet logs" 110W. In an example, wet logs 110W have a moisture content in the range of $75\% < M_C \leq 100\%$. Also, logs 110 can be partially dry logs 110P, which in an example have a moisture content in the range $25\% \leq M_C < 75\%$, with $M_C \approx 50\%$ being an exemplary value. Further, logs 110 can be nearly dry logs 110N, which in an example have a moisture content in the range $5\% \leq M_C < 25\%$. Further, logs 110 can be dry logs 110D, which in an example have a moisture content in the range $0\% \leq M_C < 5\%$, and in another example have a moisture content in the range $0\% \leq M_C < 2\%$.

In an example, the average moisture content $M_{CA}$ averaged over all of the logs 110 within a given cavity 24 during the microwave drying process is maintained between 40% and 60%.

The wet logs 110W from extruder system 100 are conveyed into cavity 24 of first applicator 20-1 at input end 12 of microwave dryer 10 via conveyor 60 and then conveyed through the applicator cavity. The first applicator 20-1 provides via microwave system 40 microwaves 50 having an amount of input microwave power $P_{I1}$ that can partially dry wet logs 110W so that they exit the first applicator as partially dried logs 110P. In an example wherein partially dried logs 110P have a moisture content $M_C$ of 50%, the logs are referred to as being "half dry."

The conveyor 60 then conveys partially dried logs 110P to and through second applicator 20-2 and its cavity 24. The microwaves 50 in second applicator 20-2 have a second amount of microwave power $P_{I2}$ that can further dry the partially dried logs 110P so that they exit cavity 24 as nearly dry logs 110N.

Conveyor 60 then conveys nearly dried logs 110N to and through third applicator 20-3 and its cavity 24. The microwaves 50 in third applicator 20-3 have a third amount of microwave power $P_{I3}$ that can further dry the nearly dry logs 110PN so that they exit the cavity as dry logs 110D.

Figure 3:
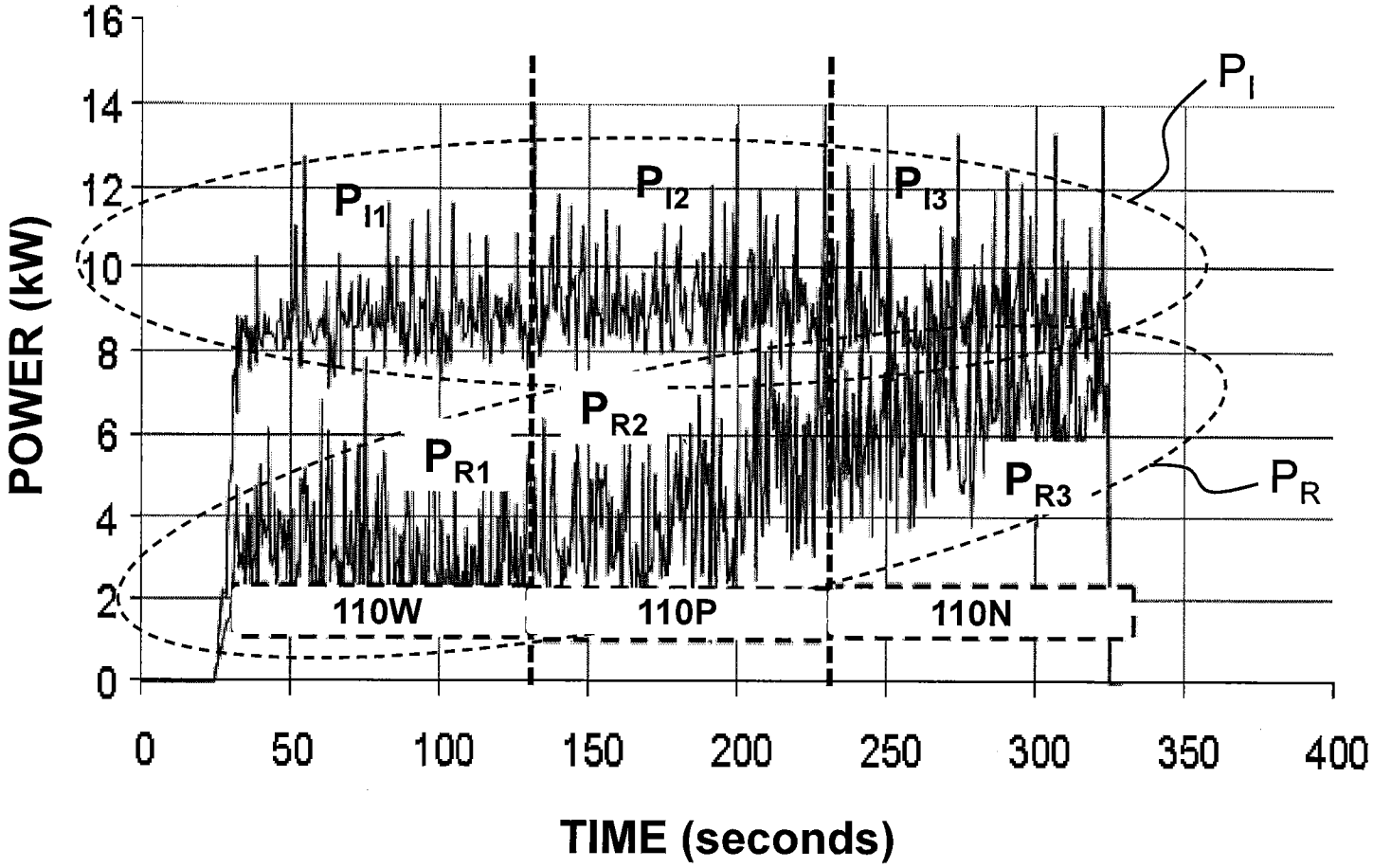
FIG. 3 is a plot of the microwave power (kW) versus time (seconds), showing a first set of data corresponding to the measured amount of input microwave power $P_I$ and a second set of data corresponding to the measured amount of reflected microwave power $P_R$, for honeycomb structures (logs) in a mostly wet state, a half-wet state and a nearly dry state, as denoted by the dashed vertical lines.

FIG. 3 is a plot of the microwave power (kW) versus time (seconds), showing two sets of experimental data. The first set of experimental data corresponds to the measured amount of input microwave power $P_I$. The second set of data corresponds to the measured amount of reflected microwave power $P_R$. The data were collected by carrying out experiments using a 915 MHz batch microwave drying system. A first step in the experiments was to monitor the variation of forward and reflected microwave power as a function of time during the drying of a log having a diameter of 5.66 inches and a length L of 8 inches. The log was made of an AT ceramic-based material, which was fired and then soaked in water.

During the experiments, it was observed that one 5.66"×8" AT-based fired log soaked in water such that it picks up 30% weight of water takes 5 minutes to dry to a 95% dryness level at 12 kW of input microwave power $P_I$. A collection of six similar logs took 19 minutes to dry to the same dryness level under similar input power conditions. This experiment showed that increasing the amount of moisture in the applicator via non-dry logs can enhance the drying throughput. In this example, the drying throughput was enhanced by about 35%, with 6 logs being dried in 19 minutes instead of 30 minutes.

The data in FIG. 3 is divided into sections corresponding to wet logs 110W, partially dry logs 110P that were halfway dried, and nearly dry logs 110N, as indicated by the dashed vertical lines. The sections of the plot associated with the input powers $P_{I1}$, $P_{I2}$ and $P_{I3}$ and the reflected powers $P_{R1}$, $P_{R2}$ and $P_{R3}$ for the three applicators is also shown. Of significance in the plot of FIG. 3 is the increase in the amount of reflected power $P_R$ with increasing log dryness. Specifically, for wet logs 110W, the mean reflected power $P_R$ stayed lower at about 3 kW, and for the partial (half-wet) logs 110P, it increased to about 4.5 kW, while for the nearly dry logs 110N, it increased further to about 7.5 kW. This clearly demonstrates the impact of the degree of log dryness (or said differently, the amount of log moisture content $M_C$) on the amount of reflected microwave power $P_R$ during microwave drying of log 110 in applicator 20.

Figure 4:
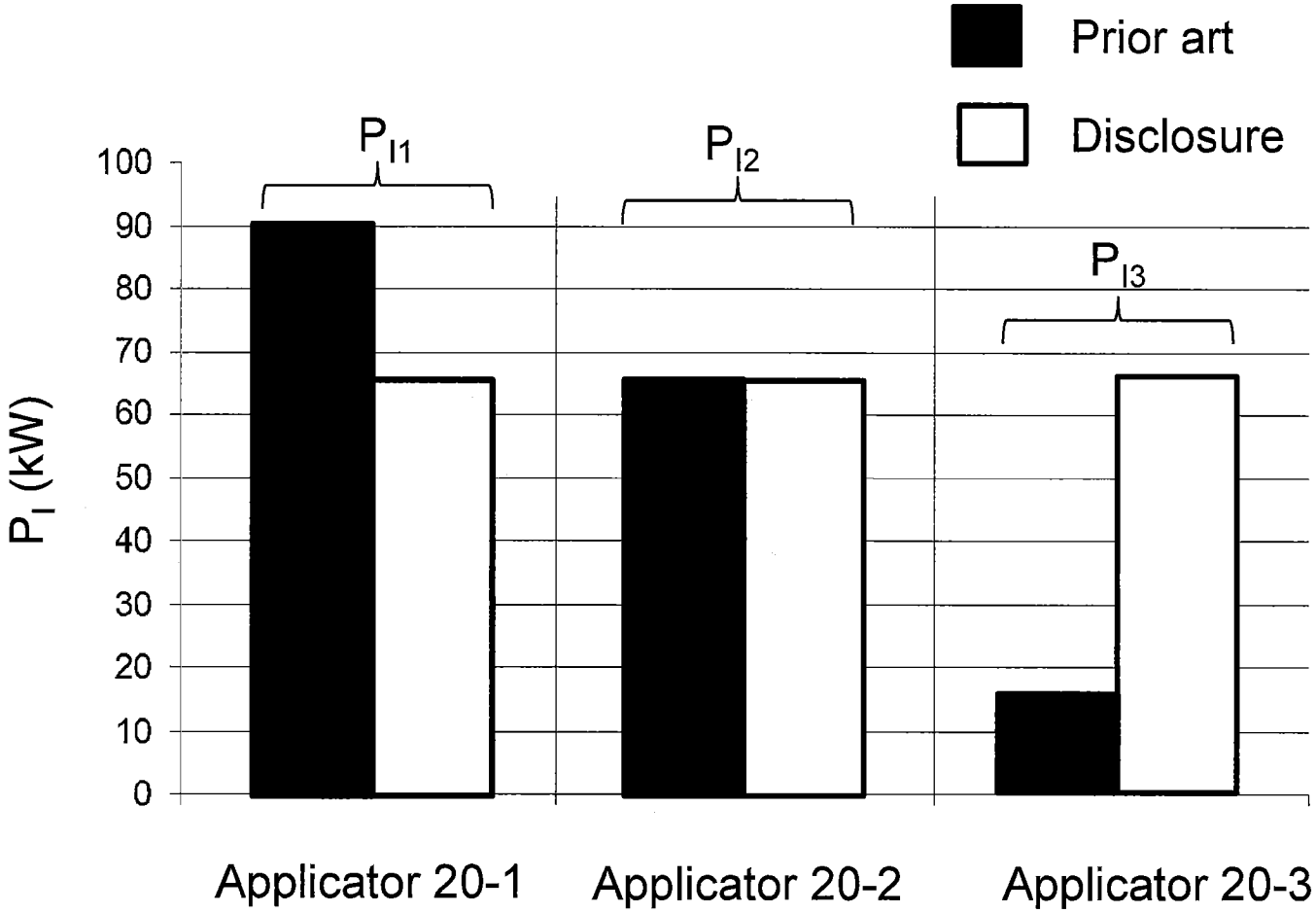
FIG. 4 is a bar graph of the input microwave power $P_I$ (kW) for the three different applicators in the microwave dryer, with one set of data (black bars) indicating the prior art input power for the applicators and another set of data (white bars) indicating the input power for the applicators according to the present disclosure.

FIG. 4 is a bar graph of the input microwave power $P_I$ (kW) for the three different applicators 20-1, 20-2 and 20-3 in microwave dryer 10. To control the amount of reflected microwave power $P_R$, the amount of input microwave power $P_I$ needs to be reduced as logs 110 get drier. The black bars in the bar graph indicate an example of how a prior art microwave dryer system was operated at reduced input microwave power $P_I$ as logs 110 got drier to keep the reflected microwave power $P_R$ at an acceptable level.

In first applicator 20-1, the corresponding input microwave power $P_{I1}$ is relatively high at about $P_{I1}$=90 kW. In second applicator 20-2, the corresponding input microwave power $P_{I2}$ is reduced to about $P_{I2}$=65 kW. In third applicator 20-3, the corresponding input microwave power $P_{I3}$ is reduced to about $P_{I3}$=15 kW. This reduction in the amount of input microwave power $P_{I3}$ reduces the efficiency of the log drying process because not all the available microwave input power is being used to dry logs 110.

Continuous Drying Process

Figure 5:
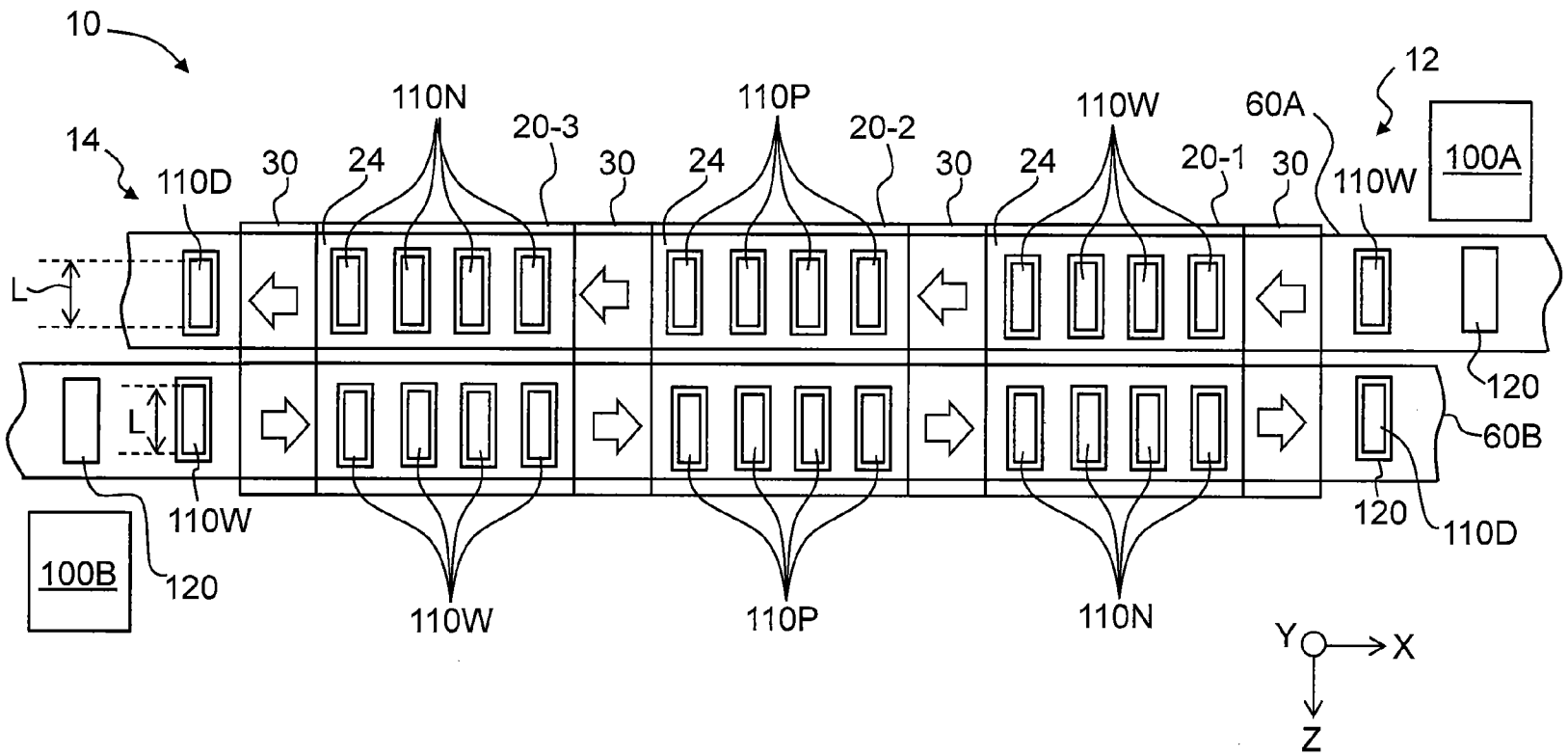
FIG. 5 is a schematic diagram similar to FIG. 2 of an example microwave dryer configuration that utilizes two conveyors that reside in the same plane and move in opposite directions so that logs are conveyed through the applicators in opposite directions, thereby maintaining substantially the same overall log moisture content in a given applicator cavity.

FIG. 5 is a schematic diagram of an example microwave dryer 10 similar to the one shown in FIG. 2 and illustrates an example system and method for a continuous drying process that leads to more efficient drying of logs 10 than is possible using prior art microwave drying systems and methods. The microwave dryer 10 of FIG. 5 is essentially the same as microwave dryer 10 of FIG. 1 and FIG. 12 except that it includes two conveyors 60A and 60B that lie generally in the same plane and that convey logs 110 (supported within trays 120) in opposite directions (i.e., the logs are counter-propagated through cavities 24).

In the configuration shown in FIG. 5, conveyor 60A conveys wet logs 110W from first end 12 and first applicator 20-1 all the way through third applicator 20-3, much like is shown in FIG. 2. However, conveyor 60B conveys wet logs 110W in the opposite direction, from second end 14 and third applicator 20-3 all the way through first applicator 20-1, much in the opposite manner of FIG. 2.

In an example, microwave dryer 10 of FIG. 5 includes two extruder systems 100A and 100B operably arranged to form wet logs 110W to be conveyed by conveyors 60A and 60B, respectively. Note, however, that a single extruder 100 can be used, and wet logs 110W can be transported from the single extruder to respective conveyors 60A and 60B for processing.

In an example, logs 110 have an axial length L that is shorter than (e.g., half the axial length of) the logs shown in FIG. 2. This allows applicator cavities 24 to accommodate the two conveyors 60A and 60B with their logs 110 and trays 120 disposed end-to-end as shown. In an example, all logs 110 that are dried using the drying methods disclosed herein have the dimensions, e.g., diameters Dx and Dy, for a log with an oval cross-section, and axial length L. In an example, logs 110 have a circular cross-section with Dx=Dy.

The configuration of logs 110 shown in FIG. 5 allows for substantially the same input microwave power $P_I$ to be maintained for each applicator. An example amount of the substantially constant input microwave power $P_I$ is shown by the white bars in the bar graph of FIG. 4, wherein $P_{I1}=P_{I2}=P_{I3}=65$ kW. The ability to provide a substantially constant input microwave power $P_I$ for each applicator 20 is due to there being substantially the same average log moisture content $M_{CA}$ in each applicator cavity 24 at any given time during the drying process.

Figure 6:
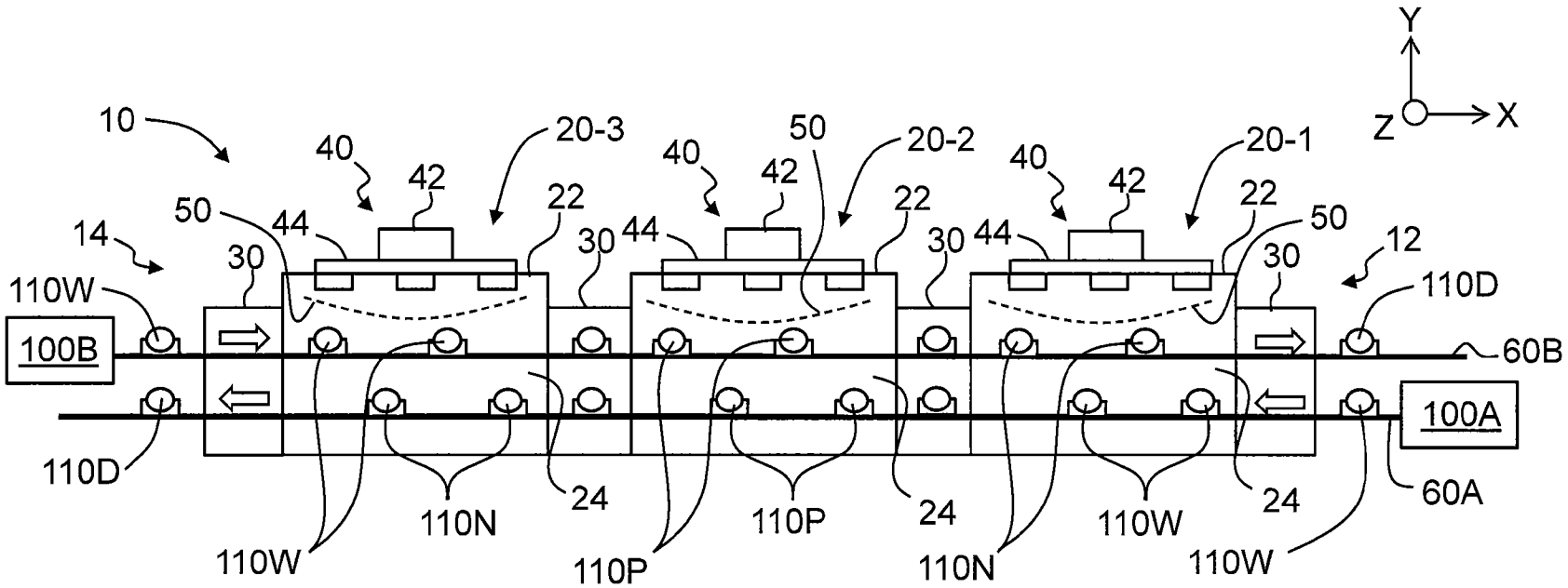
FIG. 6 is a schematic diagram similar to FIG. 1 and illustrates an example microwave dryer configuration similar to that of FIG. 4, but wherein the conveyors are in different planes.

FIG. 6 illustrates an example microwave dryer 10 having the two conveyors 60A and 60B as in the microwave dryer of FIG. 5, except that the two conveyors 60A and 60B reside in different planes, e.g., one directly above the other. This configuration provides for greater spatial separation of the logs 110 being dried. This configuration also allows for full-size trays 120 and full size logs 110 to be used. As in the example drying configuration of FIG. 5, in FIG. 6 the two conveyors 60A and 60B run in opposite directions so that substantially the same average log moisture content $M_{CA}$ is present in each applicator cavity at any given time during the drying process.

In an example, two extruder systems 100A and 100B are used in the microwave dryer 10 of FIG. 6 to extrude logs 110W at first and second microwave dryer ends 12 and 14, respectively, for conveyance by conveyors 60A and 60B, respectively.

Figure 7:
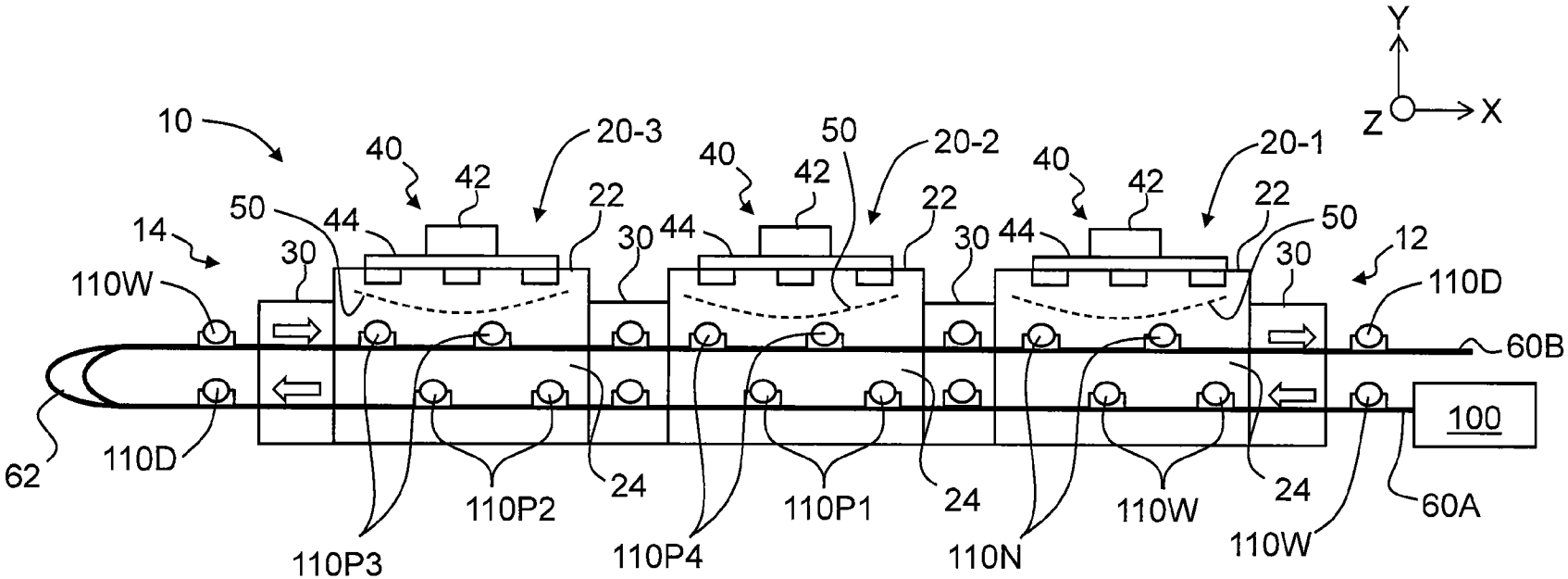
FIG. 7 is similar to FIG. 6 and illustrates an example microwave dryer configuration wherein the two conveyors are joined by a conveyor section to form a single conveyor.

FIG. 7 illustrates an example microwave dryer 10 similar to that of FIG. 6, except that the two conveyors 60A and 60B are operably joined by a conveyor section 62 to form a single conveyor 60. In an example embodiment illustrated in FIG. 8, conveyor section 62 can include a transfer station 64 that transfers (e.g., lifts) trays 120 and logs 110 therein from lower conveyor 60A to upper conveyor 60B. In another example, conveyor section 62 is a conveyor portion that includes a curved ramp that makes conveyors 60A and 60B one continuous conveyor. The example configurations of FIG. 7 and FIG. 8 enable the use of one extruder system 100.

Figure 8:
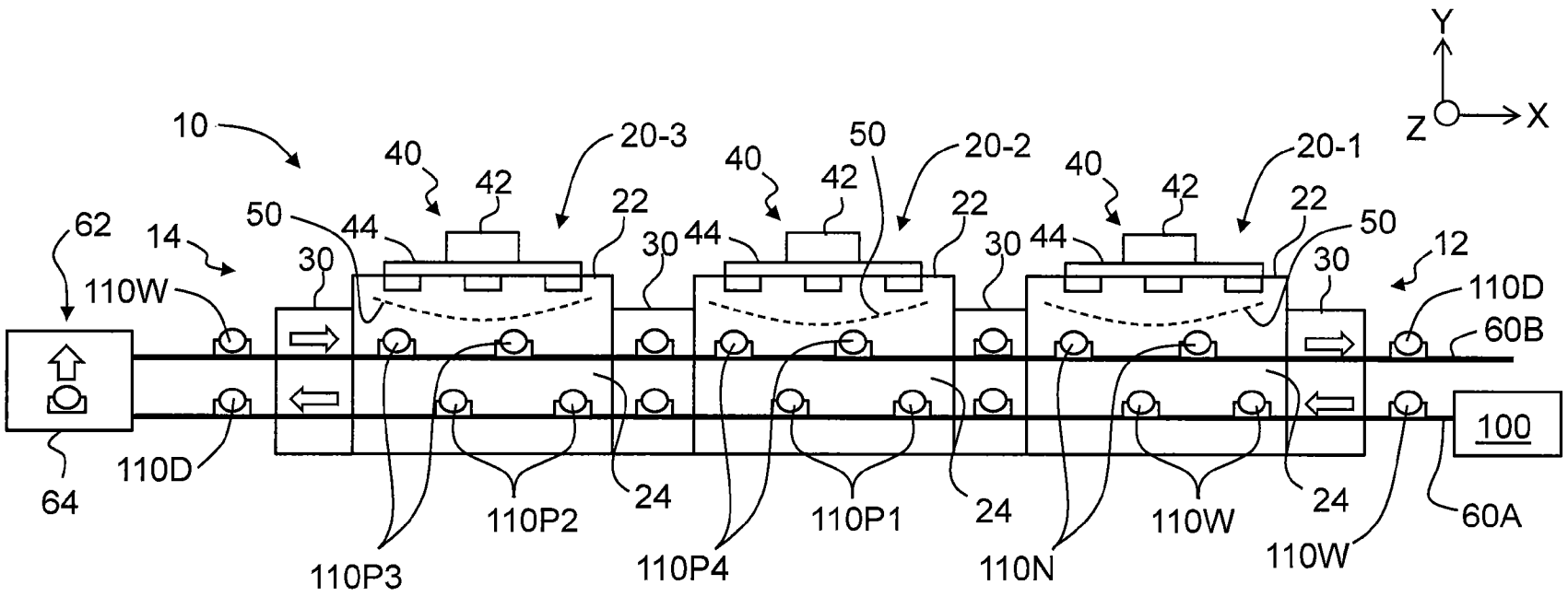
FIG. 8 is similar to FIG. 7 and illustrates an example microwave dryer configuration wherein the conveyor section includes a transfer station to transfer the tray and the log therein from one conveyor to the other.

In the example configurations of FIG. 7 and FIG. 8, the input microwave powers $P_{I1}$, $P_{I2}$ and $P_{I3}$ for applicators 20-1, 20-2 and 20-3, respectively, are is set so that logs 110W entering at first end 12 on conveyor 60A will be dry logs 110D by the time they pass through each applicator twice in different directions and exit at first end 12 on conveyor 60B. Thus, on the first pass through first applicator 20-1, wet logs 110W become partially dry logs 110P1 that are still mostly wet (e.g., 2/6 dry). These partially dry logs 110P1 are then further dried upon their first pass through second applicator 20-2 and exit the second applicator as partially dried logs 110P2 that are a bit more dry (e.g., 3/6 dry). These partially dry logs 110P2 are then further dried upon their first pass through third applicator 20-3 and exit the third applicator as partially dried logs 110P3 that are even more dry (e.g., 4/6 dry).

These partially dried logs 110P3 are then conveyed by conveyor section 62 to upper conveyor 60B, which conveys these logs back through third conveyor 20-3 in the opposite direction. These partially dry logs 110P3 are then further dried upon their second pass through third applicator 20-3 and exit the third applicator as partially dried logs 110P4 that are yet a bit more dry (e.g., 5/6 dry). These partially dry logs 110P4 are then further dried upon their second pass through second applicator 20-2 and exit the second applicator as nearly dried logs 110N. These nearly dry logs 110N are then further dried upon their second pass through first applicator 20-1 and exit the first applicator at first end 12 on conveyor 60B as dried logs 110D. Thus, at any given time in the drying process, each applicator cavity 24 contains substantially the same average amount of log moisture content $M_{CA}$ by virtue of the logs 110 therein. This in turn allows for substantially the same amount of input microwave power $P_I$ to be used for all three applicators 20, i.e., $P_{I1}\approx P_{I2}\approx P_{I3}$.

Electromagnetic Simulations

The complex dielectric constant $\in$ of a material, such as the ceramic-based material used to form logs 110, is expressed as:

$$\in=\in'+j\in'' \tag{1}$$

where $\in''$ is the imaginary part of the dielectric constant that represents the absorption of electromagnetic radiation and therefore provides an estimate of the amount of dielectric heating that occurs inside the material. The penetration depth of the electromagnetic energy is given by both $\in'$ and $\in''$. Therefore, to better describe the drying behavior of a log, the real and imaginary parts of the dielectric constant are combined to define the loss tangent:

$$\tan\delta = \frac{\varepsilon''}{\varepsilon'} \tag{2}$$

The dielectric heating (or the power loss) during microwave drying of a single log 110 is given by the dissipated power $P_{diss}$:

$$P_{diss}=2\pi f\in' \tan\delta|E_{rms}|^2 \tag{3}$$

where f is the frequency of the electromagnetic radiation and $E_{rms}$ is the root-mean-square of the electric field of microwaves 50, with $|E_{rms}|^2$ representing the intensity of the microwaves.

Equation (3) indicates that the higher the loss tangent, the greater the amount of power dissipation $P_{diss}$ inside log 110, and the greater the moisture loss due to boiling. It is therefore desirable to have a high loss tangent to ensure fast and effective log drying.

Figure 9:
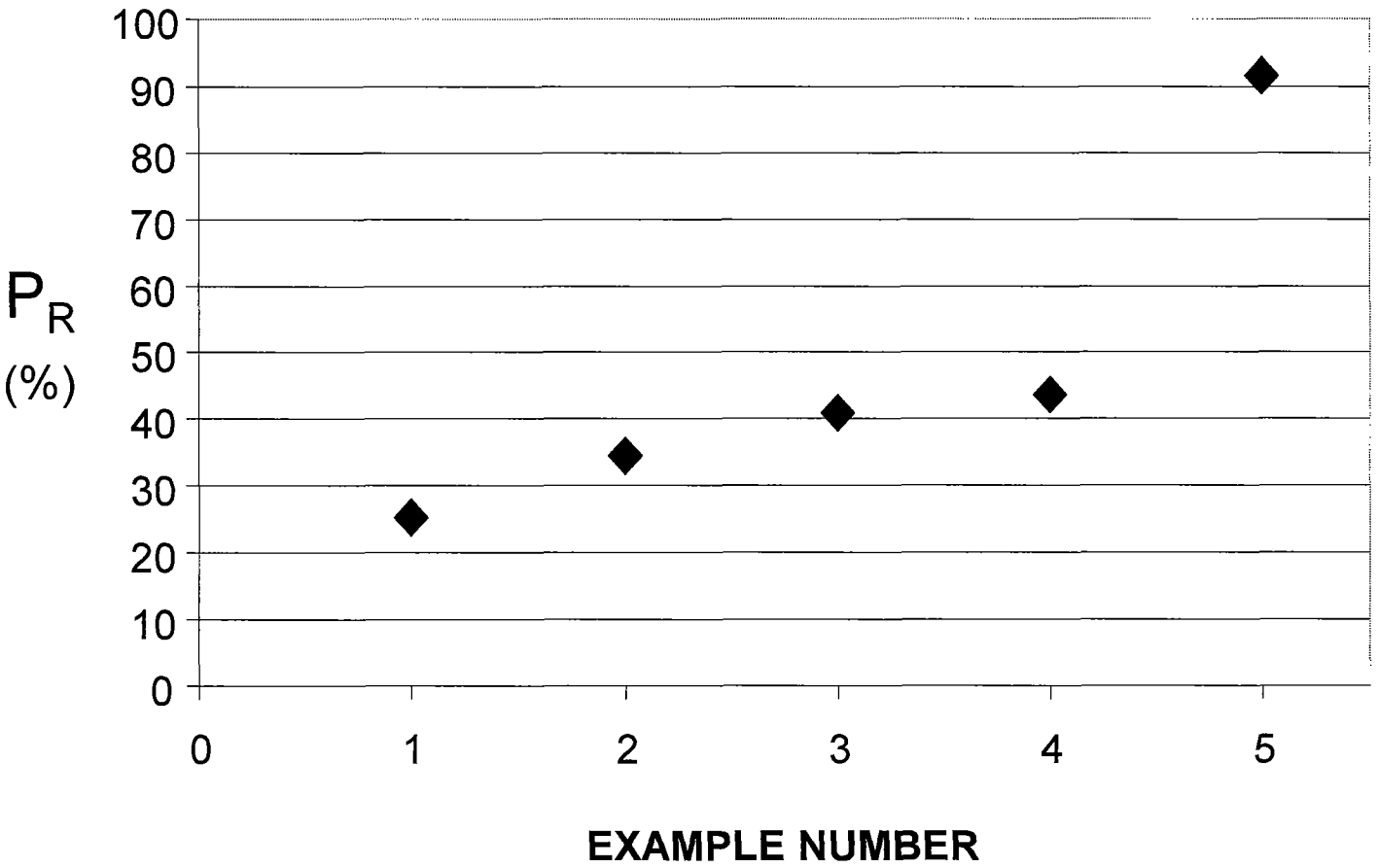
FIG. 9 is a plot of the reflected microwave power $P_R$ (%) versus Example Number for five example microwave drying situations.

Electromagnetic simulations were performed to validate the performance of the microwave drying systems and methods disclosed herein. FIG. 9 is a plot of the reflected microwave power $P_R$ (%) versus Example Number for five different example microwave drying situations ("Examples"). All of the Examples used the same ceramic-based material composition and cylindrical log shape with a diameter of about 4 inches and an axial length L of 36 inches.

Table 1 below summarizes the five Examples. Examples 1, 2 and 3 simulate sequential processing in first, second and third applicators 20, wherein wet logs 110W enter first applicator 20-1 and exit as partially dry (50%) logs 110P, which enter second applicator 20-2 and exit as nearly dry logs 110N, which are then processed by third applicator 20-3.

TABLE 1

| FIVE EXAMPLES FOR ELECTROMAGNETIC SIMULATIONS | |
|---|---|
| Example 1 | 6 wet logs 110W |
| Example 2 | 6 half-wet logs 110P |
| Example 3 | 2 wet logs 110W, 2 half-wet logs 110P and 2 dry logs 110D |

TABLE 1-continued

| FIVE EXAMPLES FOR ELECTROMAGNETIC SIMULATIONS | |
|---|---|
| Example 4 | 3 wet logs 110W and 3 dry logs 110D |
| Example 5 | 6 dry logs 110D |

With reference to the trends obtained from the simulation results in FIG. 9, Example 1 shows a reflected microwave power $P_R$ of about 25%, Example 2 shows a reflected microwave power $P_R$ of about 37%, and Example 5 shows a reflected microwave power $P_R$ of about 90%. These numbers illustrate why the input microwave power $P_I$ needs to be slightly reduced in second applicator 20-2, e.g., from 90 kW to 65 kW, due to the slight increase in reflected power, and why the input microwave power $P_I$ needs to be significantly reduced in third applicator 20-3, e.g., from 90 kW to 15 kW, as the reflected microwave power $P_R$ is almost 90% for dry logs 110D.

The simulations for Example 3 and Example 4 were based on the counter-flow configuration as discussed above in connection with FIG. 5, for the above-identified combinations of logs 110. The two counter-flow configurations (namely, conveyors 60A and 60B on the same plane and on different planes) were simulated. Example 3 shows a slightly higher reflected microwave power $P_R$ than Example 2, so that the input microwave powers $P_I$ for Examples 2 and 3 can be about the same. Example 4 shows that the reflected microwave power $P_R$ is about the same as for Examples 2 and 3, so that the input microwave power PI can also be about the same.

The electromagnetic simulations indicate that in a counter-flow drying configuration, all applicators 20 can operate at substantially the same input microwave power $P_I$. The electromagnetic simulation results are plotted in the aforementioned bar graph of FIG. 4 as the white bars and are compared to the prior art black bars, as discussed above. The simulations indicated that a total input microwave power $P_{IT}=P_{I1}+P_{I2}+P_{I3}$ for three applicators 20 can be 65 kW×3=195 kW, as compared to (90 kw+65 kw+15 kW)=170 kW using the prior art drying configuration illustrated in FIGS. 1 and 2. This represents about a 15% increase in the amount of input microwave power $P_I$ that can be used, which roughly translates into a 15% increase in the microwave drying efficiency.

Batch Microwave Drying

FIGS. 10 through 14 show an example applicator 20 with multiple logs within applicator cavity 24 and illustrate an example method of batch microwave drying of logs 110 in a manner that increases drying efficiency.

Figure 11:
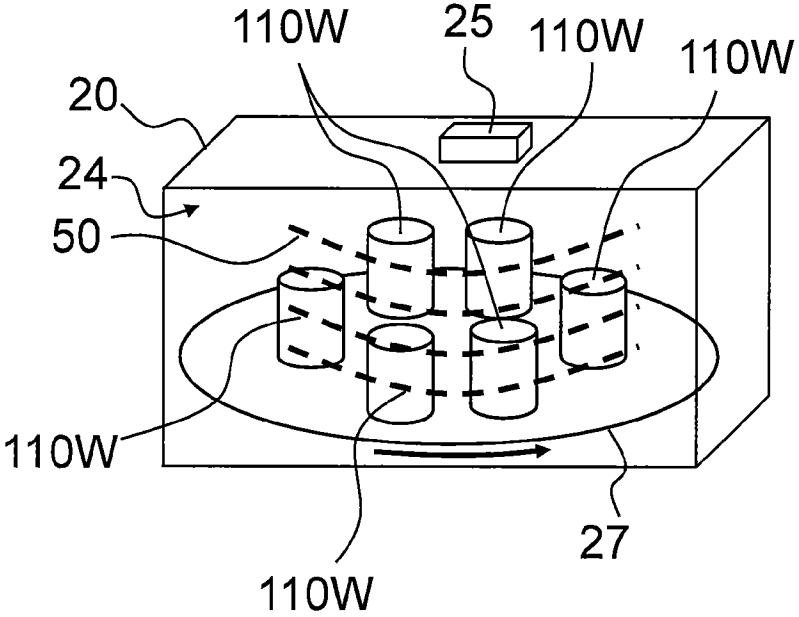
FIGS. 10 through 14 show an example applicator with multiple logs within the applicator cavity and illustrate an example method of batch microwave drying of the logs in a manner that increases drying efficiency.
Figure 10:
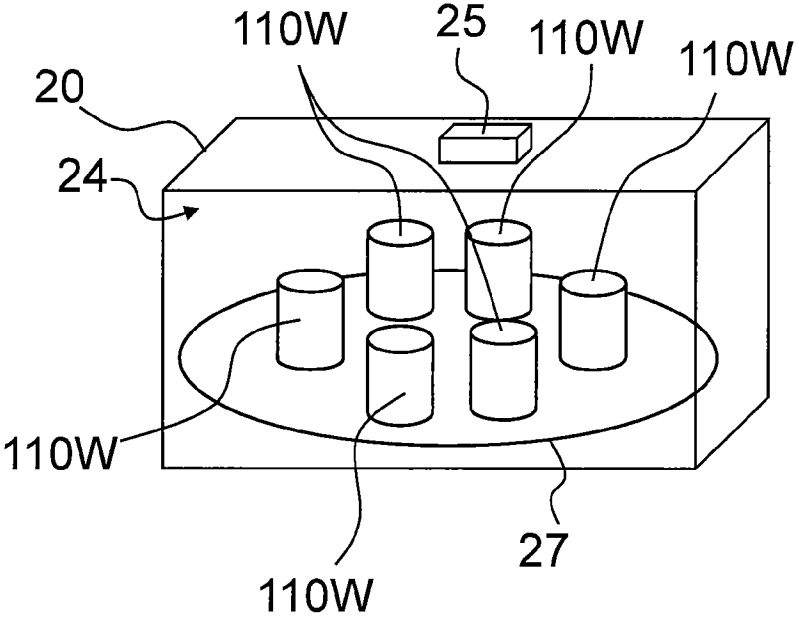
Figure 12:
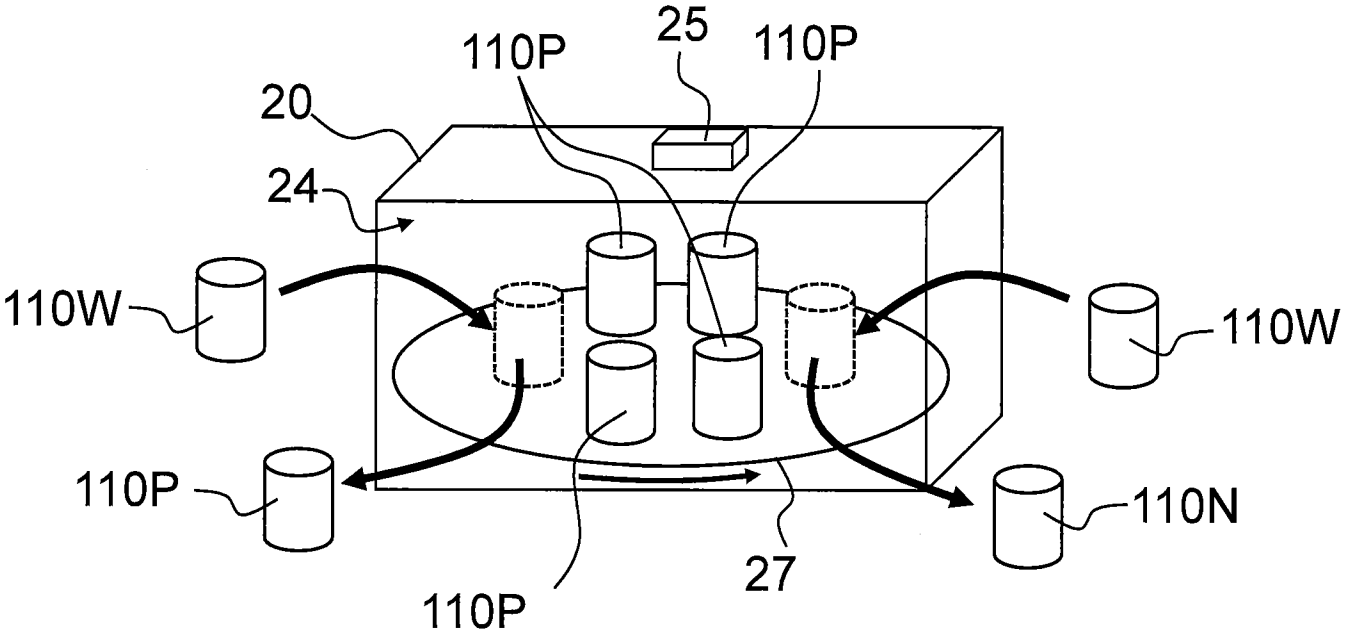

In the example applicator 20 of FIGS. 10 through 12, logs 110 are placed in and removed from cavity 24 (e.g., via a door, not shown) rather than being conveyed through the cavity from first end 12 to second end 14 as in FIG. 5. The logs 110 are supported by a plate 27, which in an example embodiment rotates during the microwave drying process.

With reference to FIG. 10, the batch microwave drying method includes introducing logs 110 into cavity 24, wherein all the logs are first wet logs 110W. The first wet logs 110W define a total drying time over which the first wet logs all become dry logs 110D for a given amount of input microwave power $P_I$ that decreases with time due to the increased amount of reflected microwave power $P_R$ as the logs become more dry.

With reference next to FIG. 11, the first wet logs 110W are irradiated with microwaves 50 at a first input microwave power $P_{I1}$ for a first period of time that is less than the total drying time. Then with reference to FIG. 12, after the microwave drying is stopped, at least one of the at least partially dry logs 110P (i.e., which can include nearly dry logs 110N or dry logs 110D, not shown) are swapped out for at least one new (second) wet log 110W.

Figure 13:
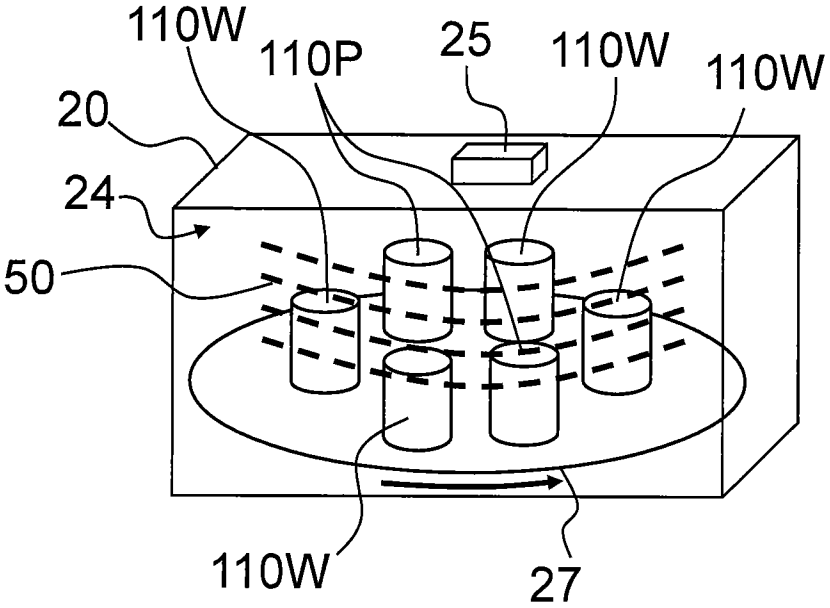
Figure 14:
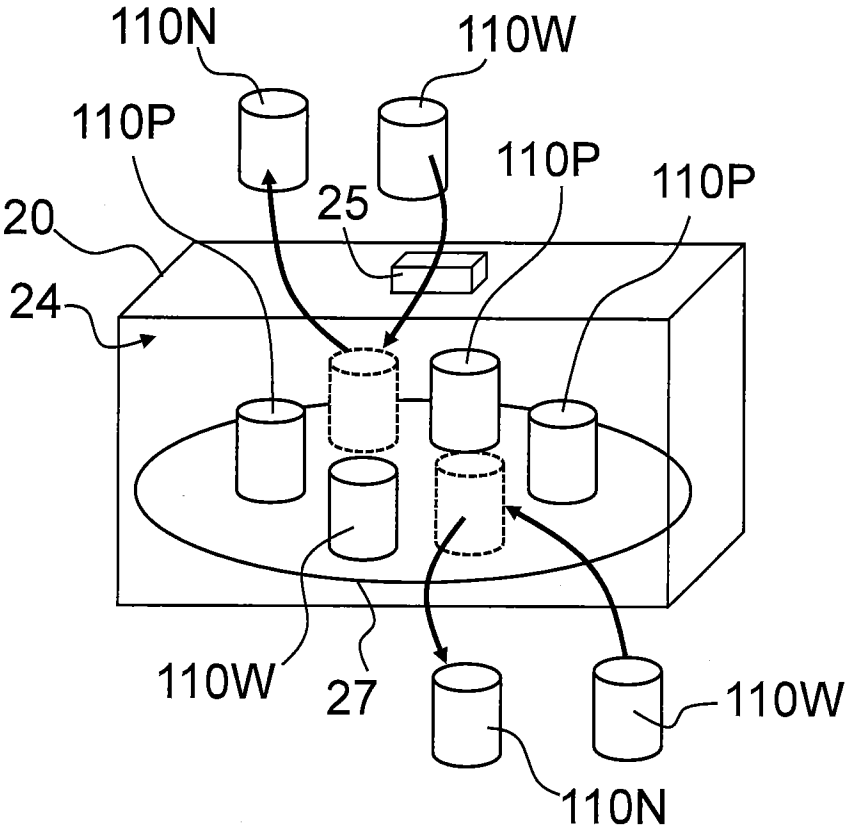

In FIG. 13, after logs 110 are swapped, the microwave drying process is continued for a second period of time with the new configuration of logs 110 in cavity 24 and a second input microwave power $P_{I2}$. The second input microwave power $P_{I2}$ is the same as or greater than the first input microwave power $P_{I1}$. This process can then be repeated by swapping in wet logs 110W for any partially dry, nearly dry or dry logs 110.

The at least one new wet log 110W can be considered a sacrificial log in the sense that it is used ostensibly to allow the second input microwave drying power $P_{I2}$ to be at least as great as the first input microwave power $P_{I1}$ and to avoid having to decrease the second input microwave power due to concerns over the amount of reflected microwave power $P_R$. This allows for faster drying of the remaining non-wet logs 110 formed from the first set of wet logs 110W.

The swapping out of non-wet logs 110P or 110N for sacrificial wet logs 110W is carried out based on the aforementioned total drying time. In an example, wet logs 110W can be swapped into cavity 24 for drier logs 110P, 110N, 110D, or a combination of these logs, one or more times in the course of the total drying time. In an example, the combined first and second drying times add up to less than the total drying time. In other words, non-wet logs 110 that are not swapped out of cavity 24 end up drying faster than if all first wet logs 110W were left in the cavity and dried until they became dry logs 110D.

In an example, at least one microwave-uniformizing device 25, which is configured to provide an increased uniformity to the microwave field distribution for microwaves 50 in applicator cavity 24, is employed. The microwave-uniformizing device 25 may include, for example, mode stirrers or rotating plate 27.

Replacing partially dry logs 110P or nearly dry logs 110N with new wet logs 110W keeps the total log moisture content $M_C$ in cavity 24 higher than if all of the logs that started out as wet logs 110W were to be allowed to progress to becoming nearly dry logs 110N. As a consequence, the input microwave power $P_I$ can be maintained rather than having to be reduced to keep the amount of reflected microwave power $P_R$ low. In FIG. 13, the microwave drying process is then reinitiated with the new configuration of logs 110 until the logs change their dryness state to, for example, that shown in FIG. 14. The nearly dry logs 110N are then swapped out for new wet logs 110W and the microwave drying process is repeated.

This method continuously moves wet logs 110W into cavity 24 in place of nearly dry logs 110N or dry logs 110D so that the amount of reflected microwave power remains low, allowing for the amount of input microwave power to remain relatively higher than if nearly dry and dry logs were allowed to remain in the cavity as the other logs were drying.

The systems and methods of the disclosure provide cost savings in the form of better use of existing equipment and energy reduction by reducing the amount of reflected microwave power. Other advantages may include better process control and predictability, higher log throughput, increased drying efficiency and improved quality of the ware made from the dried log.

Although the embodiments herein have been described with reference to particular aspects and features, it is to be understood that these embodiments are merely illustrative of desired principles and applications. It is therefore to be understood that numerous modifications may be made to the illustrative embodiments and that other arrangements may be devised without departing from the spirit and scope of the appended claims.

What is claimed is:

1. A method of efficiently drying logs in a microwave dryer having at least a first-end applicator and a second-end applicator having respective first and second cavities, comprising:

conveying first wet logs from the first to the second cavity while microwave drying the first wet logs in the first cavity to form first partially dry logs that enter the second cavity, and microwave drying the first partially dry logs in the second cavity to form first dry logs that exit the second cavity; and conveying second wet logs from the second cavity to the first cavity during microwave drying of the first partially dry logs in the second cavity, thereby forming second partially dry logs that enter the first cavity, and microwave drying the second partially dry logs in the first cavity during microwave drying of the first wet logs in the first cavity to form second dry logs that exit the first cavity.

2. The method according to claim 1, further comprising inputting first and second amounts of microwave power $P_{I1}$ and $P_{I2}$ into the first and second cavities, respectively, wherein $P_{I1} \approx P_{I2}$.

3. The method according to claim 1, wherein each cavity has associated therewith an amount of reflected microwave power $P_{R1}$ and $P_{R2}$ due to the logs therein, and wherein $P_{R1}$ is about the same as $P_{R2}$ and wherein $P_{R1} < (0.2)P_{I1}$ and $P_{R2} < (0.2)P_{I2}$.

4. A method of microwave drying extruded logs, comprising:

arranging first and second sets of wet logs respectively at a first end of a first applicator having a first cavity and at a second end of a second applicator having a second cavity;

counter-propagating the first and second sets of logs through the first and second applicator cavities while maintaining substantially equal amounts of input microwave power in each cavity; and outputting the first set of wet logs from the second cavity as a first set of either nearly dry logs or dry logs, and outputting the second set of wet logs from the first cavity as a second set of either nearly dry logs or dry logs.

5. The method according to claim 4, further comprising maintaining an average moisture content in each of the first and second cavities of between 40% and 60%.

* * * * *